US006581809B1

(12) United States Patent
McElhinney

(10) Patent No.: US 6,581,809 B1
(45) Date of Patent: Jun. 24, 2003

(54) COMBINED IRON, PRESS AND STEAMER FOR HATS

(76) Inventor: Sarah McElhinney, 47 Glen Ave., Riverhead, NY (US) 11901

( * ) Notice: Subject to any disclaimer, the term of this patent is extended or adjusted under 35 U.S.C. 154(b) by 0 days.

(21) Appl. No.: 10/020,696

(22) Filed: Dec. 11, 2001

(51) Int. Cl.[7] ..... A41H 43/00
(52) U.S. Cl. ..... 223/51
(58) Field of Search ..... 223/26, 21, 25, 223/24, 51; 38/13, 12; 219/222, 225, 227–229, 243, 255, 533, 524; 156/583.8, 583.9; 100/315, 326, 92, 73, 234; 34/411, 552; 132/223, 224, 228, 272

(56) References Cited

U.S. PATENT DOCUMENTS

| | | | |
|---|---|---|---|
| 388,497 | A | 8/1888 | McLoughlin |
| 406,214 | A | 7/1889 | Harsin |
| 434,438 | A | 8/1890 | Fitz et al. |
| 1,102,399 | A | 7/1914 | Eilau |
| 1,492,083 | A | 4/1924 | Pegues |
| 1,720,602 | A | 7/1929 | Liverant |
| 1,888,375 | A | 11/1932 | Diener |
| 2,008,638 | A | 7/1935 | Cuming |
| 4,157,151 | A | 6/1979 | Sanko |
| 4,927,063 | A | 5/1990 | Fricano |
| 5,163,589 | A | 11/1992 | Biehl |
| 5,829,175 | A | 11/1998 | Marchetti et al. |
| 5,862,522 | A | 1/1999 | Cho |
| 5,957,140 | A | 9/1999 | McGee |
| 6,052,928 | A | 4/2000 | Lin |
| 6,070,596 | A | 6/2000 | Altamore |
| 6,191,387 | B1 | 2/2001 | Smal |
| 6,223,753 | B1 | 5/2001 | Lo |

FOREIGN PATENT DOCUMENTS

| | | |
|---|---|---|
| FR | 8221.222 | 11/1937 |
| GB | 320534 | 10/1929 |

*Primary Examiner*—John J. Calvert
*Assistant Examiner*—James G Smith
(74) *Attorney, Agent, or Firm*—Tony A. Gayoso

(57) ABSTRACT

The invention relates to an iron, press and/or steaming device for hats. In particular, it is directed at steaming or pressing baseball caps. The invention comprises two semi-spherical halves that are attached by a handle. The handle can be squeezed and made to collapse to make the two flat inner faces of the semi-spherical halves press together. Once pressed together, the two semi-spheres should look like a single sphere. Located on both the rounded outer surfaces and the flat inner surfaces of both semi-spheres are numerous steam vents. By squeezing the two halves together, the user can apply the flat inner surfaces of the semi-spheres as a steam press. This is particularly useful for pressing the bill/brim of a baseball cap or other hat. The spherical outer surface is useful for placing inside a hat for steaming. In a first embodiment the sphere in its fully expanded state is approximately half the diameter of an ordinary hat. A user when steaming the inside of a hat must apply tension manually to de-wrinkle the hat while steaming. In an alternate embodiment, the expanding sphere (from when the handle is released) would fill the inside of the hat, pulling it taught. The inner workings, which generate the steam, would be similar to traditional steamers, including water reservoirs and the like.

20 Claims, 8 Drawing Sheets

COMBINED IRON, PRESS AND STEAMER FOR HATS

COPYRIGHT NOTICE

A portion of the disclosure of this patent document contains material that is subject to copyright protection. The copyright owner has no objection to the facsimile reproduction by any one of the patent document or the patent disclosure, as it appears in the Patent & Trademark Office, patent file or records, but otherwise reserves all copyright rights whatsoever.

BACKGROUND OF THE INVENTION

Historically, apparatus designed to iron, steam or press hats have been large and cumbersome commercial machinery that are both expensive and not intended to be transported easily. Due to the costs of such commercial machinery, professionals generally use them in either the manufacture of hats or the business of maintenance or repairing of hats.

There are many caps or hats, such as baseball caps, that while valued by their owners are relatively inexpensive. Thus, it is generally not cost effective to bring a baseball cap, or the like, to a professional for cleaning or maintenance. Most people who even bother to try to clean such a hat will do so either manually or in a washing machine. However, these people are then faced with the dilemma of how to have the hat keep its shape after the cleaning and drying process. In other words, the hats tend to lose their desired shape and get wrinkled after being cleaned.

In order to solve this problem, various forms, clamps and other mechanical devices have been devised to stretch the caps or press their surfaces in an attempt to keep a desired shape. Such mechanical devises, while helping somewhat to maintain the intended form of the hats do not always eliminate wrinkles in the hat's fabric.

While relatively inexpensive and portable steam irons are commonplace for use on traditional clothing, these devises do not work very well on contoured surfaces. These traditional household irons are intended to de-wrinkle fabric, using a flat support undersurface. Such a technique does not work very well for the rounded and spherical surfaces of a hat, particularly the crown or domed portion of the hat.

SUMMARY OF THE INVENTION

The present invention relates to a portable iron, press and steamer for hats. While this apparatus can be used on hats and other materials that can be ironed, pressed or steamed, it is particularly directed at steaming or pressing baseball caps.

The invention relates to an apparatus comprising two semi-spherical halves that are attached to two handles. The two semi-spheres are configured so that when they are made to touch one another, they form a complete sphere. Also, each semi-sphere is designed to include heated surfaces, which vent steam. These two semi-spherical halves are used for ironing, pressing and steaming a hat. Particularly, the outer surface of each semi-sphere contains numerous steam holes or vents. By placing the two semi-spheres inside the crown of a hat, the heated steaming curved surfaces can be used to steam or iron the inside of the hat. Further, the inner surfaces of the semi-spheres are designed to press or iron other portions of the hat such as the brim. By placing the brim between the inner sides of the two semi-spheres and then pressing the two semi-spherical halves toward one another, the inner surfaces act as a press. Similar to the outer surfaces, the inner surfaces can be heated and also contain numerous steam holes or vents, to add moist heat to the press.

DESCRIPTION OF THE DRAWINGS

Those and other objects and advantages of the present invention will become more apparent by referring to the following detailed description and accompanying drawings in which.

DETAILED DESCRIPTION OF THE PREFERRED EMBODIMENTS

Figure 1:
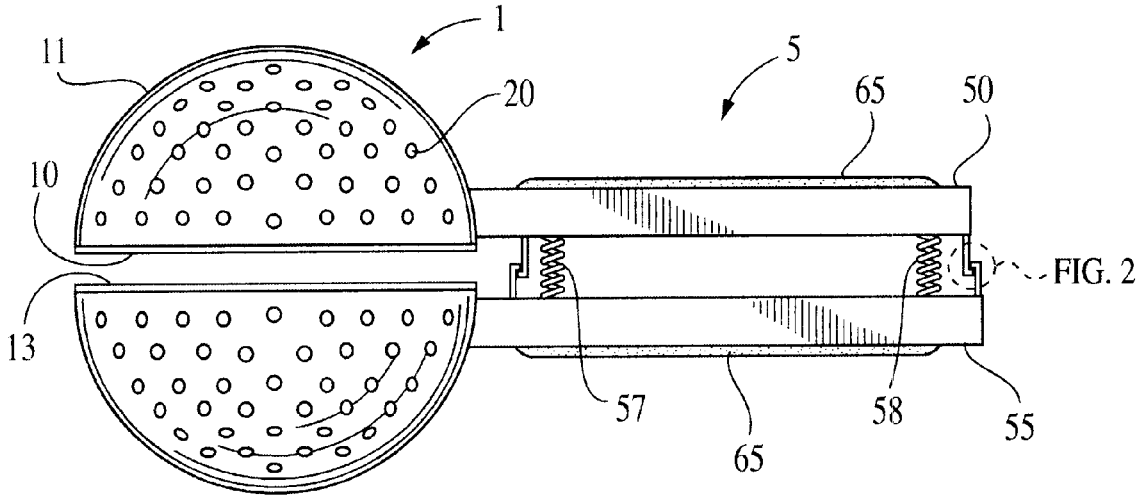
FIG. 1 shows a side view of the present invention in its open position, with the handle portion in partial section.

The first embodiment of the combined iron, press and steamer of the instant invention is seen in FIG. 1. The general reference 1 comprises the heated spherical section of the device, which is made up of two semi-spherical domes 11, 12. These domes 11, 12 each include numerous vent or steam holes 20 on their outer surfaces. The inner surfaces of the domes also include ironing/press surfaces 10, 13, which contain vent or steam holes 21 that are similar to the outer surface vents 20. The second general reference 5 comprises the handle section of the device, which is made up of two semi-cylindrical sections 50, 55. Optionally, the handle section 5 can be provided with easy grip material 65, which can also add stylistic features to the device.

Figure 2:
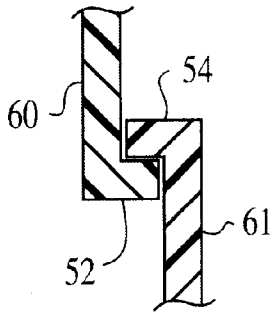
FIG. 2 shows a relief section of the rear stop tabs of the present invention.
Figure 4:
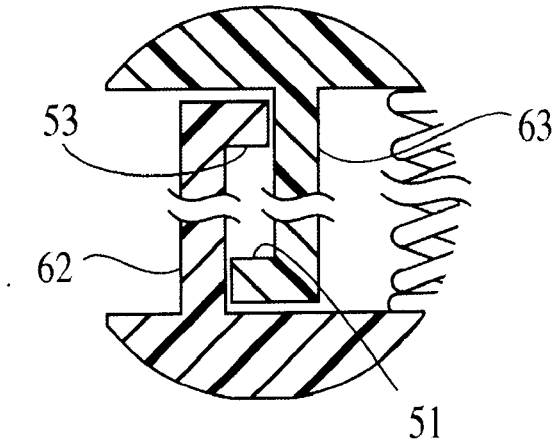
FIG. 4 shows a relief section of the front stop tabs of the present invention.

The handles 50, 55 are designed in such a way as to provide a mechanism for biasing the two semi-spheres 11, 12 away from one another. Each semi-sphere 11, 12 is attached to only one handle section 50, 55. The biasing mechanism can be one or more coil springs 57, 58 or any similar mechanism with similar properties. The biasing mechanisms 57, 58 is intended to push the two handle sections 50, 55 away from one another, such that the two semi-spherical halves 11, 12 have a tendency not to touch when a user does not intend them to do so. FIG. 2. shows some detail of the stop tabs 52, 54 that limit the distance the two semi-spherical halves 11, 12 can separate. Similar stop tabs 51, 53 are seen in FIG. 4.

The apparatus is said to be in the "fully open" position when the two ironing/press surfaces 10, 13 of the semi-spheres 11, 12 are not touching and are at the point of maximum separation. The biasing mechanism is therefore intended to maintain the device in its fully open position, unless acted upon by a user through squeezing of the handle portions 50, 55. As the stop tabs 51–54 limit the amount of separation between the semi-spheres, it is anticipated that they could be adjustable in such a way as to allow a user to change or adjust the separation limit. While such an adjustable feature is not shown in the drawings, it would involve extending or retracting an adjustable version of the handle shields 60–63 that support the extensions stop tabs 51–54.

Figure 3:
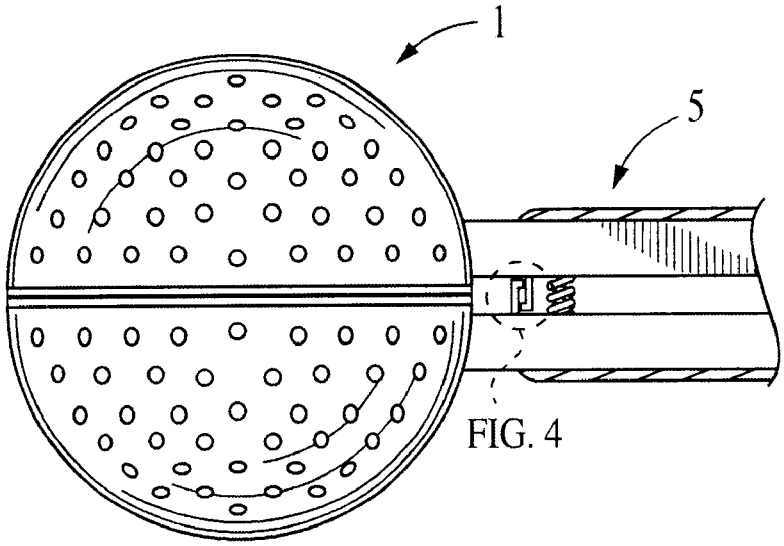
FIG. 3 shows a side view of the present invention in its closed position, with some of the handle portion in partial section.

FIG. 3 illustrates the apparatus in its "fully closed" position. It is intended that the two ironing/press surfaces 10, 13 come in contact when the user squeezes the handle to its limit. While the ironing/press surfaces 10, 13 themselves will provide a fully closed limit, the apparatus could be designed alternatively to use the tab stops 51–54 to limit how close the ironing/press surfaces 10, 13 can come, as seen in FIG. 4. In this way, the tab stops would limit how close the ironing/press surfaces 10, 13 could get.

Figure 5:
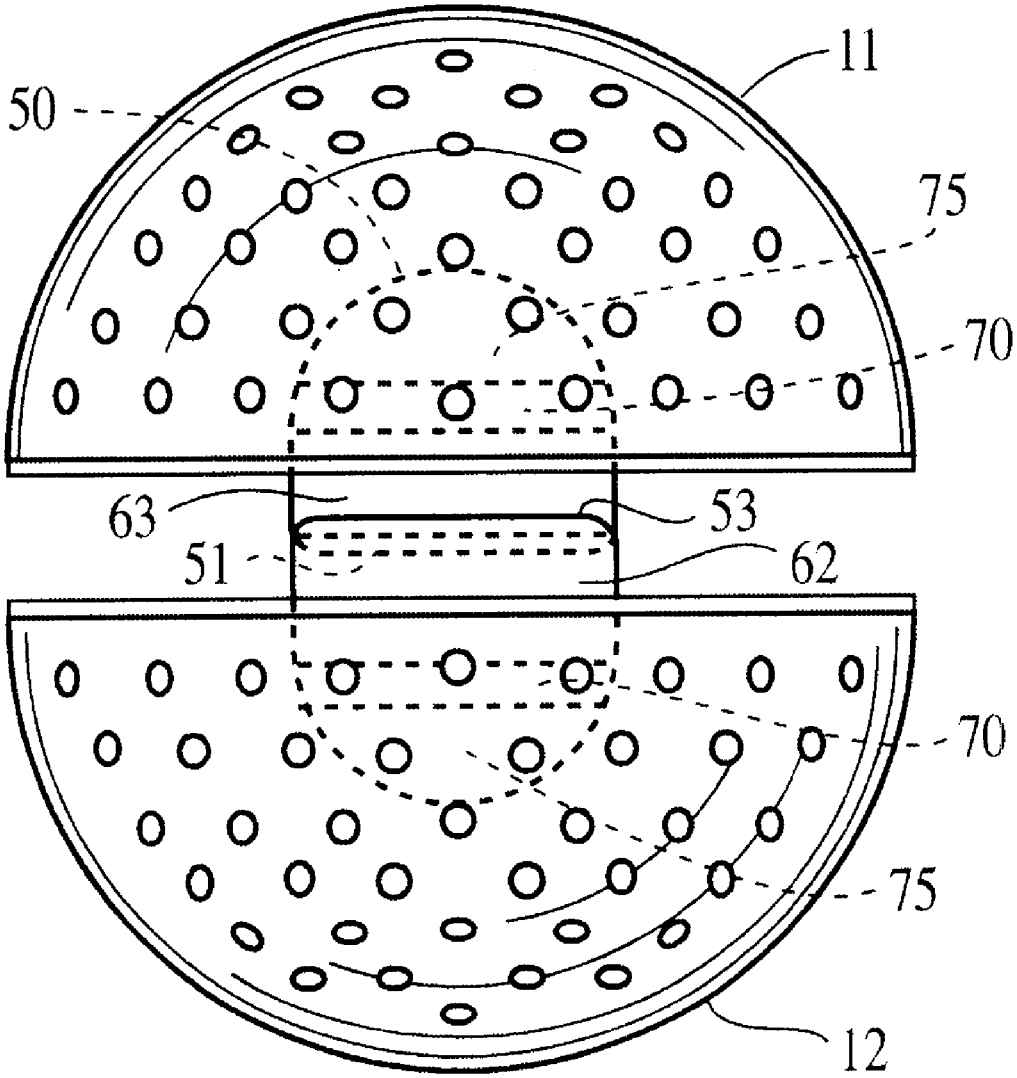
FIG. 5 shows a front view of the present invention in an open position, without the details on either semi-sphere.
Figure 6:
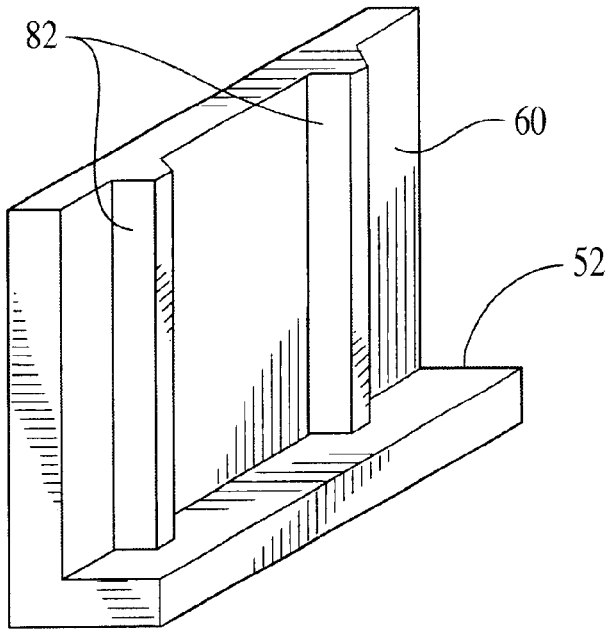
FIG. 6 shows the detail of the guides incorporated onto one of the handle shields.
Figure 7:
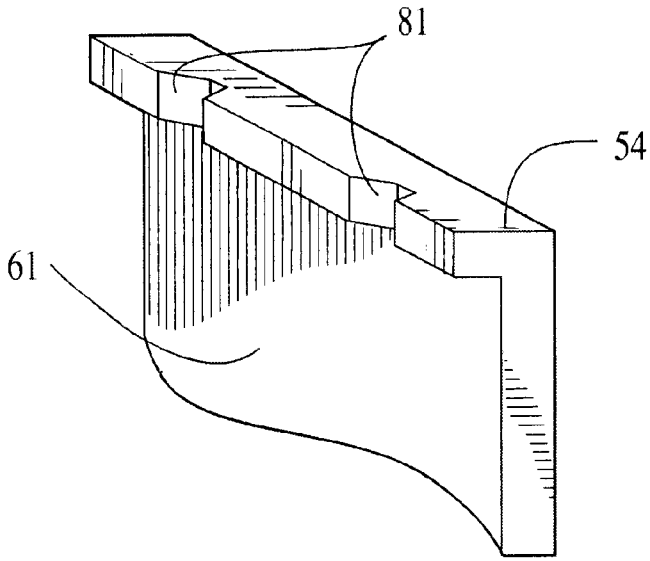
FIG. 7 shows the detail of the guide tracks incorporated onto one of the handle shields.

FIG. 5 shows a front view of the invention in the open position. In this view, the inner sections 70 of the handles 50, 55 can be seen through the two domes 11, 12. Also seen in this view, is how the front handle shields 62, 63 overlap. FIGS. 6 & 7 illustrate how the handle shields 60–63 could be provided with grooves 81 and guides 82 for controlling the stop tabs 51–54 and preventing lateral movement between the upper and lower sections of the device.

Figure 8:
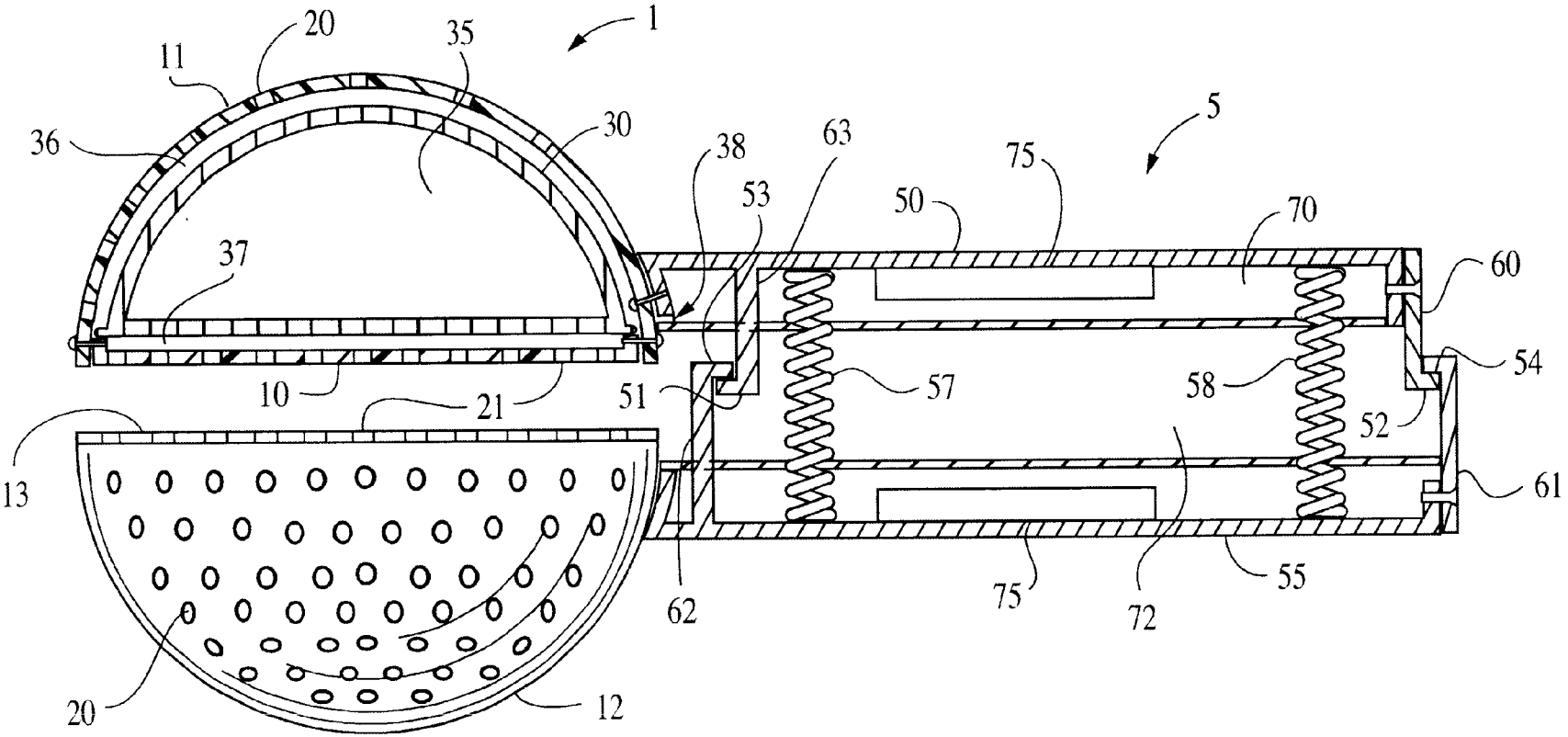
FIG. 8 shows a side view of the present invention in the open position in partial section.

The partial section view shown in FIG. 8 illustrates the inner mechanics of the preferred embodiment of the instant invention. The semi-spherical domes 11, 12 each have inner semi-spherical chamber 35. The radius of the inner chamber walls 30 are slightly less than the radius of the inside wall of the domes 11, 12. In this way, a dome steam passage 36 is provided to distribute steam from inside the domes 11, 12 through the steam vents 20. Also, a similar gap 37 is provided between the inside of the ironing/press plates 10, 13 and the inner chamber wall 30. This ironing/press plate gap 37 provides a passage to distribute steam from inside the domes 11, 12 through the steam vents 21. Alternative designs for the shape and size of the inner chamber 35 are clearly anticipated. By changing the shape and/or size of the inner chamber 35 and its walls 30, relative to the outer semi-sphere, the steam passages 36, 37 can be made more or less efficient for their intended purpose. For example, the steam passages could be made wider in the areas most remote from their source. Also, rather than a simple gap 36, 37 between the inner chambers 35 and the outer semi-spheres 11, 12, channels, groves or even tubing can be provided to convey the steam as intended. Further, the configuration of the steam holes/vents on the outer semi-spheres 11, 12 can obviously be modified to optimize or control their performance. Likewise, the size of each individual hole could be modified.

Also seen in FIG. 8 is a generalized depiction of a combined motor, heater and steam generating device 75. This combined device 75, is intended to represent the mechanisms used to generate steam and heat the surfaces of the semi-spheres 10, 11, 12, 13. In the preferred embodiment, this device 75 is located in the inner sections 70 of the handles 50, 55. However, it is understood that such a motor/heater/steam generating device 75 could be located in any hollow space of the device such as the inner most handle chamber 72 or the inner semi-spherical chambers 35. What is more, such a motor/heater/steam generating device 75 could be comprised of numerous parts that are distributed in multiple hollow spaces of the device 35, 70, 72. For example, a power converter could be located in the handle inner sections 70, while the steam-generating device and heating elements could be located inside the domes 11, 12. Regardless of the location of such distributed devices, coated electrical wiring and circuits would be provided to transfer the power or control signals from one to the other. What is more, whatever hollow spaces are not being taken-up by the motor/heater/steam generating device 75 (whether it is comprised of one unit or multiple units) can be used to store the water that will be converted to steam, and the converted steam ready to be forced out the vents 20, 21.

In the preferred embodiment, the inner semi-spherical chamber 35 could be used to store the water supply. Tubing must be provided to transfer water from the water supply chamber(s) to the motor/heater/steam-generating device 75. Further, additional tubing must be provided to transfer the steam from the motor/steam-generating device 75 to the different steam passages 36, 37. Moreover, the dome steam passages 36 should be supplied by independent tubing or passages from those used to supply the ironing/press plate passages 37, so that the user can selectively send steam to each portion of the device. At least one passage 38, for either tubing and/or wiring, is needed from the inner handle area 70 to the inner semi-sphere area 35, 36, 37.

Figure 9:
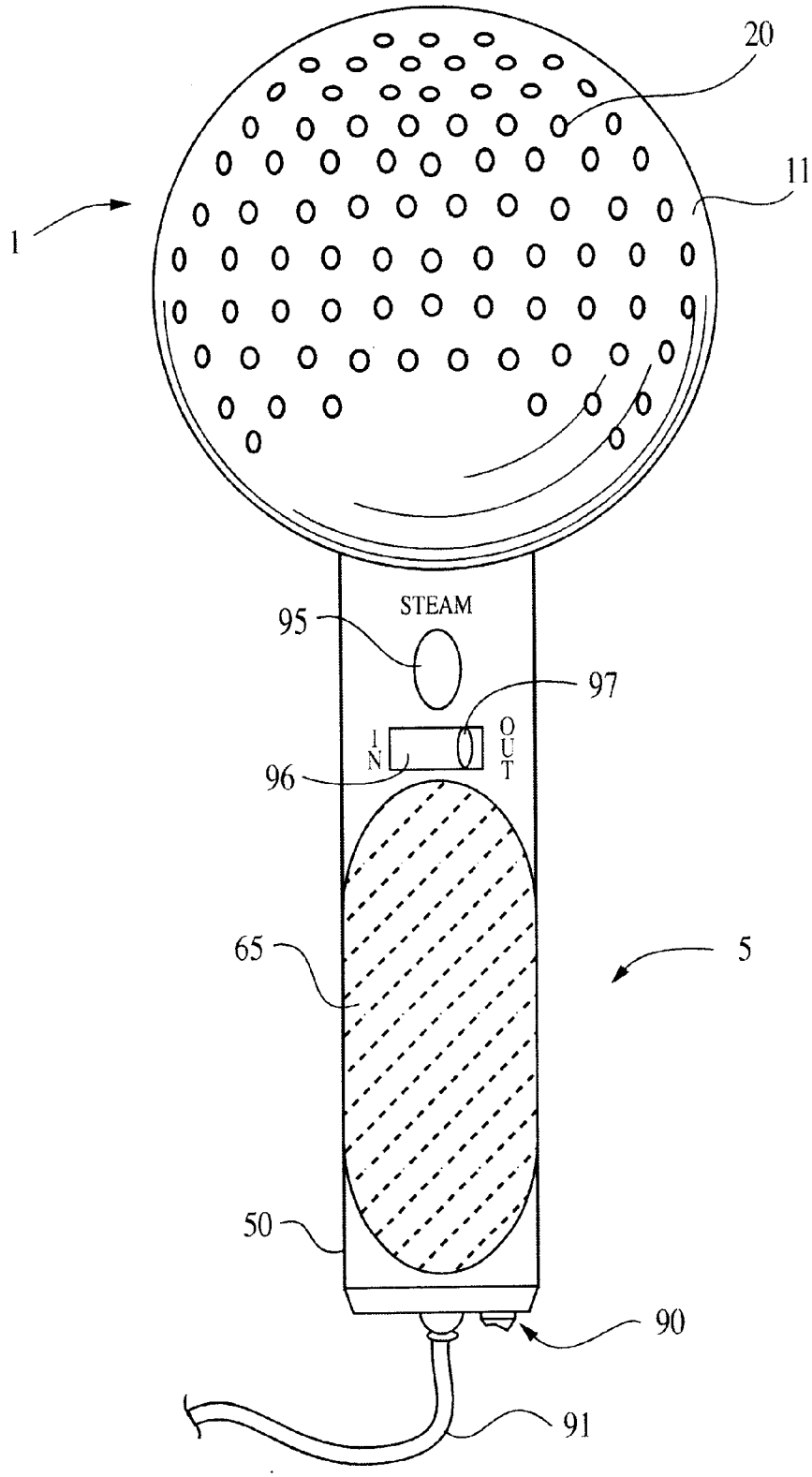
FIG. 9 shows a top view of the present invention.

As seen in FIG. 9, the outer handles contain the controls for the device. Namely, the power or On/Off switch 90, a button or trigger 95 to activate the release of steam from the device, and a selector switch 96, 97. The selector switch 96, 97 allows a user to control whether steam is released from the inner vent holes 21 (seen as the "IN" position on the switch) or whether the steam is released from the outer vent holes 20 (seen as the "OUT" position on the switch). Additionally, while a power cord 91 is shown in the preferred embodiment, it is obvious that disposable or rechargeable batteries or similar energy cells could power the apparatus.

Figure 10:
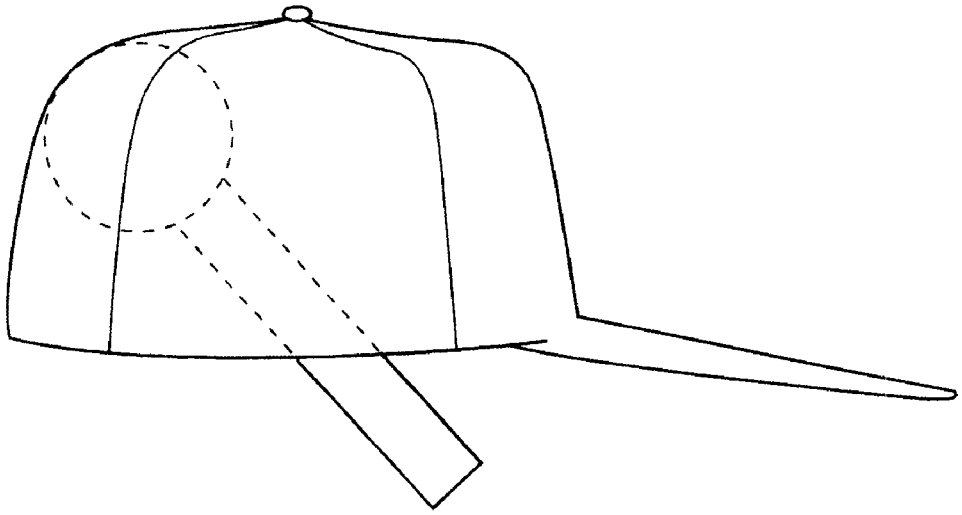
FIG. 10 shows the present invention being used to steam the inside of a cap.
Figure 11:
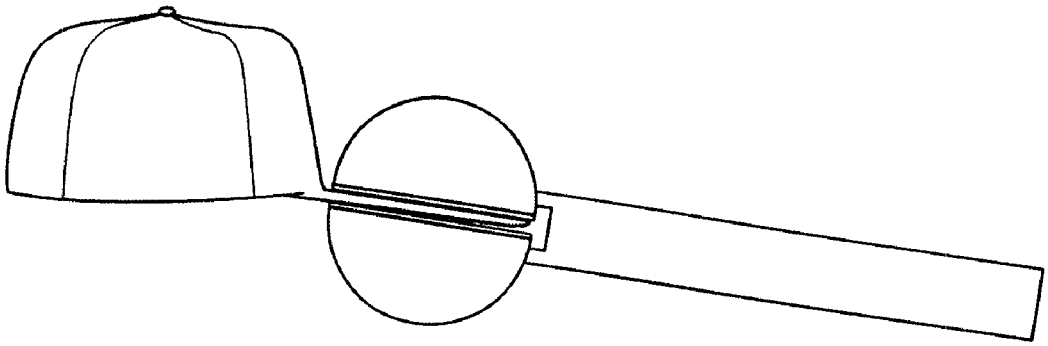
FIG. 11 shows the present invention being used to iron/press the brim of a cap.

The mechanical operation of the invention is straightforward. By squeezing the two halves of the handles 50, 55 together, the user will draw together the ironing/press plates 10, 13. Thus, the ironing/press plates 10, 13 can be applied to a fabric like a steam press. This is particularly useful for pressing the bill/brim of a baseball cap or other hat, as seen in FIG. 11. The spherical outer surfaces 11, 12 are useful for placing inside a hat for steaming. A user could use various steaming techniques, such as simply releasing steam into the inside of the hat. However, by using the spherical end of the device 1, the user could apply some tension to the fabric of the crown of the hat, while applying steam, in order to make the fabric taught and de-wrinkle the hat, as seen in FIG. 10.

In an alternate embodiment the expanding sphere (expanded the closed position to the open position) would be designed to fill and stretch the inside of a standard hat. In other words, the diameter of the combined semi-spheres 1 would be slightly smaller than the average hat diameter. In such an embodiment, however, once the semi-spheres 1 are allowed to fully separate, they would stretch the hat's fabric while steaming it taught.

Further, it is anticipated that as the size of the device can be altered as a manufacturing choice, so to could the shape be modified. For example, another shape that could better fill the inside of a hat or cap would be desirable, as the crown of most caps to not have a precise spherical shape.

Figure 12:
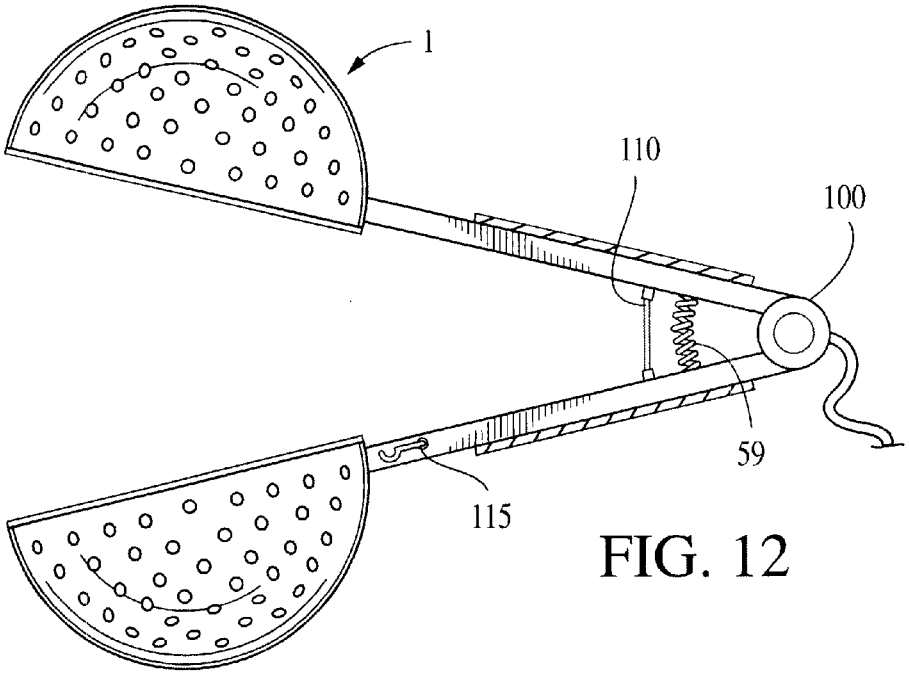
FIG. 12 shows a side view in partial section of an alternate embodiment of the present invention in an open position.
Figure 13:
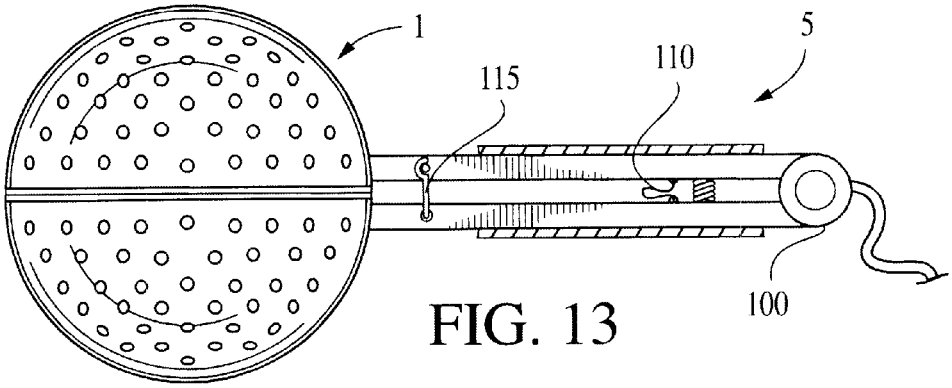
FIG. 13 shows a side view in partial section of an alternate embodiment of the present invention in a closed position.

In yet another embodiment of the present invention, as seen in FIGS. 12 & 13, the "open" and "closed" positions could be achieved with a different handle configuration. A hinged handle configuration could provide a greater expansion between the two semi-spheres 11, 12. Such a design is achieved by using a pivot hinge 100 attached at the end of the handles 5, opposite the semi-spheres 1. A biasing mechanism 59, similar to those described above would be employed. Also, as with previous embodiments, it is desirable to limit how far apart each semi-sphere 11, 12 can get from the other. While the embodiment shown employs an adjustable strap 110, other devices could be used. For example, tab stops could be designed into the pivot hinge 100 in order to limit the degree of rotation of that hinge. FIGS. 12 and 13 should also be noted, as they demonstrate the use of a locking mechanism 115 which can maintain the device in its closed position.

Figure 14:
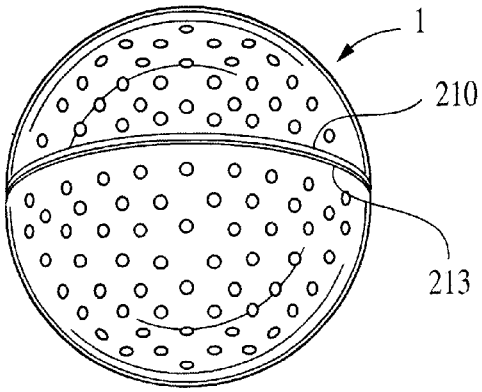
FIG. 14 shows a front view of an alternate embodiment of the present invention in a closed position.

Finally, yet another embodiment of the instant invention is seen in FIG. 14. By providing mating curved ironing/press plates 210, 213 a user could more easily achieve the curved shape commonly used on baseball cap brims.

Thus it is apparent that there has been provided in accordance with the invention that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What is claimed is:

1. A steaming and pressing apparatus comprising:

a first semi-spherical head attached to the end of a first handle, a second semi-spherical head attached to the end of a second handle, and spring means for biasing apart said first and second semi-spherical heads, wherein at least one of said first and second semi-spherical heads includes a heated surface, and at least one of said first and second semi-spherical heads includes a plurality of steam vents.

2. The apparatus of claim 1, wherein at least one of said first and second handles is capable of nesting inside at least a portion of the other of said first and second handles.

3. The apparatus of claim 1, wherein each semi-spherical head includes at least one heated surface.

4. The apparatus of claim 3, wherein at least one heated surface is located on a portion of said semi-spherical head that faces the other of said semi-spherical heads.

5. The apparatus of claim 3, wherein each semi-spherical head includes a plurality of steam vents.

6. The apparatus of claim 1, wherein each semi-spherical head includes a plurality of steam vents.

7. The apparatus of claim 1, wherein said first and second handles are moveable toward one another and are controlled by a guiding apparatus.

8. The apparatus of claim 7, wherein said guiding apparatus comprises a linear track.

9. The apparatus of claim 7, wherein said guiding apparatus comprises a curved track.

10. The apparatus of claim 9, wherein said curved track comprises a hinge attached to both said first and second handles.

11. The apparatus of claim 1, wherein at least one of said semi-spherical heads comprises a flat portion that faces the other of said semi-spherical heads.

12. The apparatus of claim 11, wherein each of said semi-spherical heads includes a flat portion and wherein said flat portions can be made to come in contact with one another by moving said handles toward one another.

13. The apparatus of claim 1, wherein each of said semi-spherical heads includes an inner curved surface and wherein said inner curved surfaces can be made to come in contact with one another by moving said handles toward one another.

14. The apparatus of claim 13, wherein the shape of the inner curved surface of each of said semi-spherical heads is shaped to conform to the shape of the inner curved surface of the other of said semi-spherical heads.

15. An apparatus comprising;

a pair of handles each having a medial end and a distal end;

a pair of half-sphere shaped heads attached to the medial ends of said handles, wherein at least one of said heads includes a heated surface;

at least one biasing mechanism, which causes at least a portion of said handles to move apart; and an end stop which limits the movement of those portions of said handles that move apart.

16. The apparatus of claim 15, wherein at least one of said heads includes a plurality of steam vents.

17. The apparatus of claim 15, wherein said handles are moveable toward and away from one another guided by a track, which causes said heads to move toward and away from one another in like manner.

18. The apparatus of claim 17, wherein said track is a hinge attached to the distal ends of said handles.

19. The apparatus of claim 15, further comprising:

a flat portion on each of said heads wherein said flat portions can be made to come in contact with one another by moving said handles toward one another.

20. The apparatus of claim 15, further comprising:

a curved inner portion on each of said heads wherein said curved inner portions can be made to come in contact with one another by moving said handles toward one another.

* * * * *